US008640878B2

(12) United States Patent
Greve et al.

(10) Patent No.: US 8,640,878 B2
(45) Date of Patent: Feb. 4, 2014

(54) TILT ROLLER GRADER WITH PLURALITY OF JACKS

(75) Inventors: Christopher G. Greve, Covington, LA (US); Robert S. Lapeyre, New Orleans, LA (US)

(73) Assignee: Laitram, L.L.C., Harahan, LA (US)

( * ) Notice: Subject to any disclaimer, the term of this patent is extended or adjusted under 35 U.S.C. 154(b) by 94 days.

(21) Appl. No.: 13/420,296

(22) Filed: Mar. 14, 2012

(65) Prior Publication Data

US 2013/0240416 A1 Sep. 19, 2013

(51) Int. Cl.
*B07B 1/49* (2006.01)
*B07B 1/16* (2006.01)

(52) U.S. Cl.
CPC ..... *B07B 1/16* (2013.01)
USPC ..... 209/412; 209/363; 209/663; 209/654; 198/604

(58) Field of Classification Search
USPC ..... 209/363, 365.2, 409, 412, 654, 663; 198/604, 814, 816, 835
See application file for complete search history.

(56) References Cited

U.S. PATENT DOCUMENTS

| | | | | | |
|---|---|---|---|---|---|
| RE12,297 | E | * | 12/1904 | Strain | 209/663 |
| 1,649,883 | A | * | 11/1927 | Woodward | 209/349 |
| 1,770,916 | A | * | 7/1930 | Griffin et al. | 209/663 |
| 2,964,181 | A | | 12/1960 | Demarest et al. | |
| 3,213,740 | A | * | 10/1965 | Wright et al. | 83/564 |
| 4,221,035 | A | | 9/1980 | Thatcher | |
| 4,380,294 | A | * | 4/1983 | Morris | 209/540 |
| 4,609,110 | A | | 9/1986 | Schulman et al. | |
| 4,881,633 | A | * | 11/1989 | Cailey et al. | 198/816 |
| 2012/0193272 | A1 | * | 8/2012 | Greve et al. | 209/245 |

FOREIGN PATENT DOCUMENTS

DE 3532364 A1 3/1987

OTHER PUBLICATIONS

"Model G-8 Grading System" brochure, copyright 2007, Laitram Machinery, Inc., New Orleans, LA, U.S.A.

* cited by examiner

*Primary Examiner* — Gerald McClain
(74) *Attorney, Agent, or Firm* — James T. Cronvich

(57) ABSTRACT

A tilt roller grader for grading solid objects, such as shrimp. The grader has grading rollers obliquely arranged across a tilted grading bed. Jacks in cross members supporting the bed are used to jack up the grading bed across its width to adjust the flatness of the bed for uniform grading gaps between the grading rollers and the bed.

11 Claims, 6 Drawing Sheets

TILT ROLLER GRADER WITH PLURALITY OF JACKS

BACKGROUND invention relates generally to apparatus for grading or sorting solid objects and more particularly to grading apparatus having gauging passages between a tilted bed and a set of parallel grading rollers obliquely arranged across the bed.

Tilted graders having oblique grading rollers are used to sort objects into different sizes, or grades. Solid objects that are graded include food products such as fruits, vegetables, nuts, shellfish, portions of meat, poultry, and fish, and non-food products, such as bearings, castings, and aggregates. One kind of grader often used to grade shellfish, such as raw shrimp, comprises a grading bed tilted from a higher upstream end to a lower downstream end. Shrimp are fed onto the bed at its higher upstream end. Aided by gravity and water, the shrimp slide down the declining bed. Parallel grading rollers extend obliquely across the width of the bed. The rollers are separated from the bed by gaps, which are successively smaller from the upstream-most grading roller to the downstream-most roller. The gaps define consecutive gauging passages. Shrimp too large to fit through the gap at a grading roller are augered along the obliquely arranged roller by a helical ridge on the roller's periphery and dropped off the side of the grader into a container or onto a conveyor. The smaller shrimp pass under the grading roller to the next grading roller, whose gap is smaller. Thus, each roller sorts shrimp of a certain grade off the side of the grader.

For accurate grading, the grading bed, which is typically a sheet of metal, should have a flat upper surface without bumps and dips, especially in the vicinity of the grading rollers, to maintain a uniform gap along the entire length of each grading roller.

SUMMARY

A grader embodying features of the invention and providing uniform gauging passages and other advantages comprises a grading bed that declines from an upstream infeed end to a lower downstream end. The grading bed extends in width from a first side to a second side and provides a top grading surface and an opposite bottom surface. A support underlies the grading bed across a space. Biasing means bias the grading bed toward the support. Grading rollers having axes of rotation extend axially across the width of the grading bed oblique to the first and second sides. The grading rollers are spaced above the grading bed across gaps. Jacks extend from the support and through the space between the support and the grading bed generally along lines parallel to and proximate to the grading rollers and into contact with the bottom surface of the grading bed. The jacks are adjustable in height in the space between the support and the grading bed to maintain the top grading surface flat proximate the grading rollers for a uniform gap at each roller.

Another version of a grader comprises a grading bed that declines from an upstream infeed end to a lower downstream end and extends in width from a first side to a second side. Grading rollers extending across the width of the grading bed are spaced above the grading bed across gaps. The grading rollers have axes of rotation oblique to the first and second sides. A gap-height adjuster is coupled to an end of each grading roller to adjust the height of the gap between the grading roller and the grading bed. The gap-height adjuster has a display displaying a measure of the height of the gap.

Yet another version of a grader comprises a grading bed declining from an upstream infeed end to a lower downstream end and extending in width from a first side to a second side. across gaps. The grading rollers have axes of rotation oblique to the first and second sides and one or more helical grooves recessed into the rollers' peripheries.

Another version of a grader comprises a grading bed declining from an upstream infeed end to a lower downstream end and extending in width from a first side to a second side. Grading rollers extending across the width of the grading bed are spaced above the grading bed across gaps. A bearing assembly at an end of each of the grading rollers includes a cylindrical bearing and a bearing holder rotatably receiving the cylindrical bearing. The cylindrical bearing includes two bearing portions having confronting faces together defining a radial hole that receives one of the ends of the grading roller. A play remover biases one of the bearing portions against the other in the bearing holder to reduce play in the end of the grading roller.

BRIEF DESCRIPTION OF THE DRAWINGS

These aspects and features of the invention, as well as its advantages, are described in more detail in the following description, appended claims, and accompanying drawings, in which:

DETAILED DESCRIPTION

Figure 1:
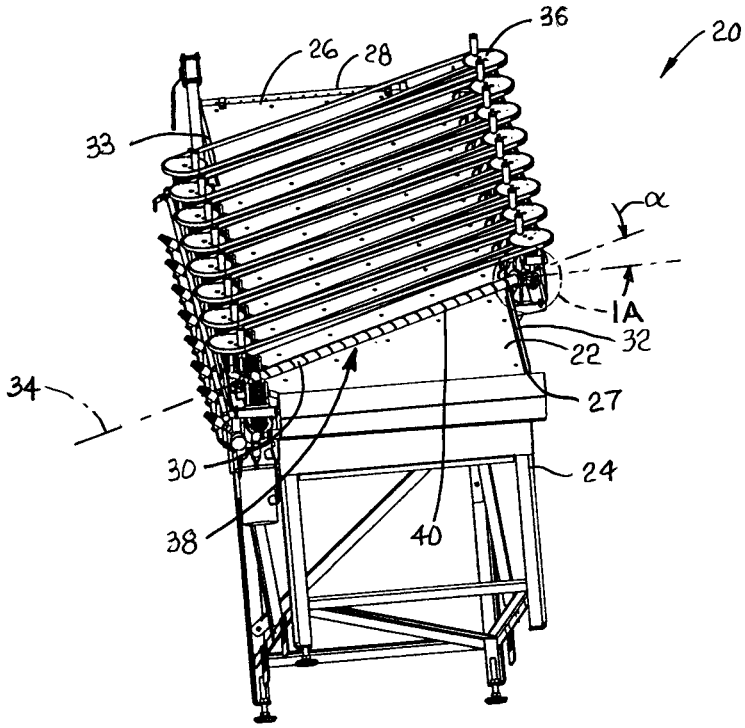
FIG. 1 is a view of a tilt grader embodying features of the invention from a bottom perspective.

A grader embodying features of the invention is shown in FIG. 1. The grader 20 comprises a grading pan, or bed 22, supported on a slant in a frame 24. The grading bed 22 extends from an upstream infeed end 26 to a lower downstream end 27. Shrimp or other products to be graded are fed or deposited onto the grading bed at the infeed end 26. A fluid pipe 28 at the infeed end flows a liquid, such as water, onto the grading bed 22 to help urge shrimp down the declining bed with the help of gravity.

A plurality of grading rollers 30—in this example, eight rollers forming eight grading zones—extend obliquely across the width of the grading pan 22 from a first side 32 to a second side 33. The grading rollers 30 rotate on parallel axes of rotation 34 that form oblique angles a with the first and second sides 32, 33 of the grading bed. Each of the grading rollers 30 has an associated gap-height adjustment mechanism 36 for adjusting the gap 38 between each roller and the grading bed 22 by simultaneously raising or lowering both ends of the roller. The gauging gaps 38 decrease from upstream to downstream so that larger shrimp are sorted off the grader before smaller shrimp. Shrimp that do not fit under a given roller's gap are guided by the oblique roller towards its lower end on the second side 33 of the grader and into a container (not shown) or onto a takeaway conveyor (not shown). Narrow helical ridges 40 formed on or helical grooves 42 (FIG. 2) recessed in the peripheries of the grading rollers 30 engage the shrimp that are too large for the gap and auger them along the roller and off the second side of the bed.

Figure 1A:
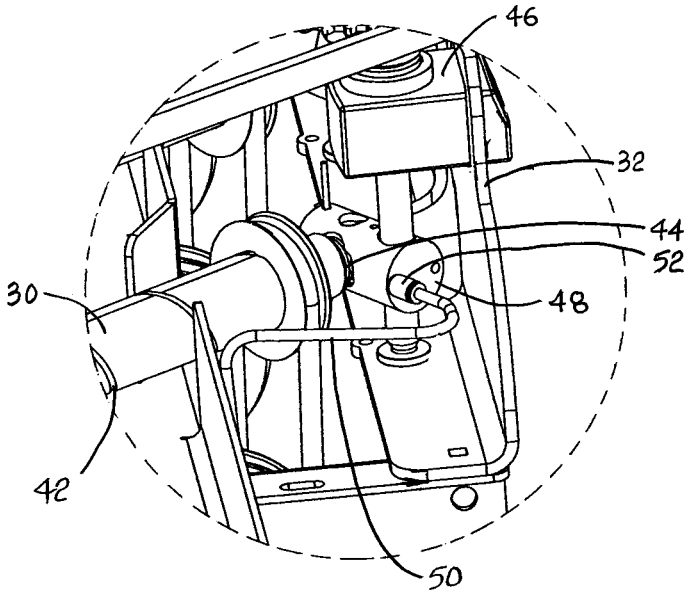
FIG. 1A is an enlarged view of the roller bearing portion of the grader of FIG. 1.

As shown in FIG. 1A, each grading roller 30 has an axle 44 at each end. At the first side 32 of the grader, the gap-height adjustment mechanism has a gap-height adjuster 36 with a vertically adjustable bearing assembly 48 that rotatably supports the axle 44. The bearing assembly is fluid- or water-lubricated by a lubrication tube 50 connected to a fluid source at one end and to the bearing assembly through an adapter 52 that forms a fluid passage into the assembly.

Figure 2:
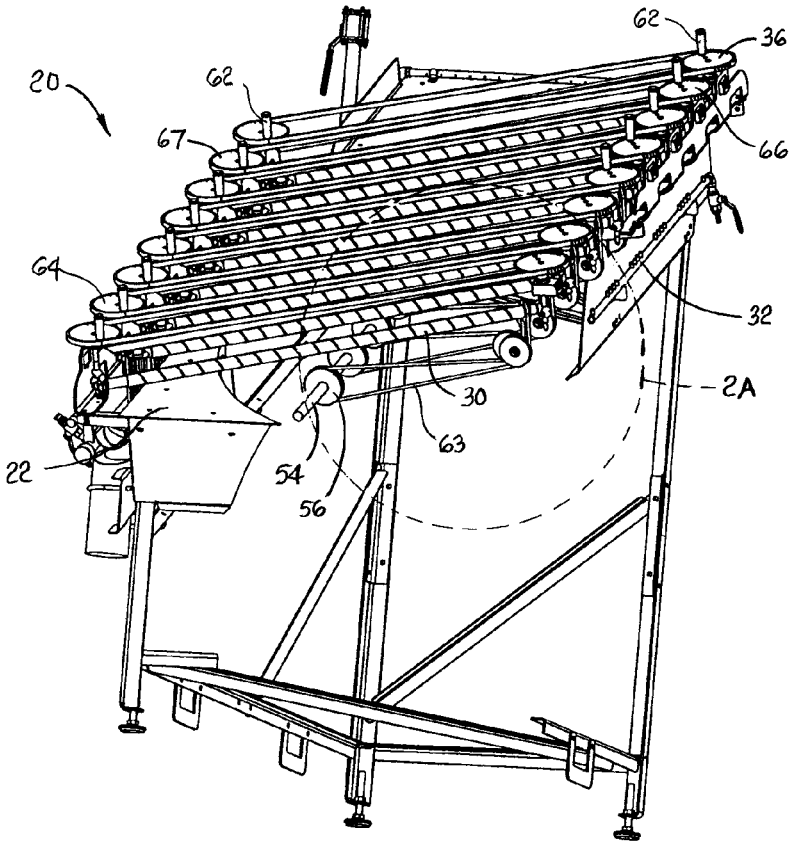
FIG. 2 is a partly cutaway view of the grader of FIG. 1 from another perspective.
Figure 2A:
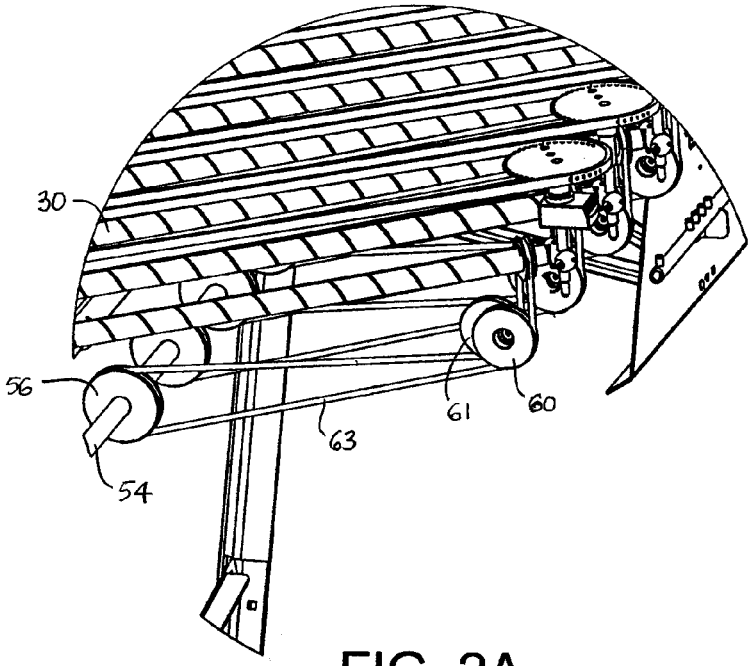
FIG. 2A is an enlarged view of the roller and roller-drive portion of the grader of FIG. 2.
Figure 6:
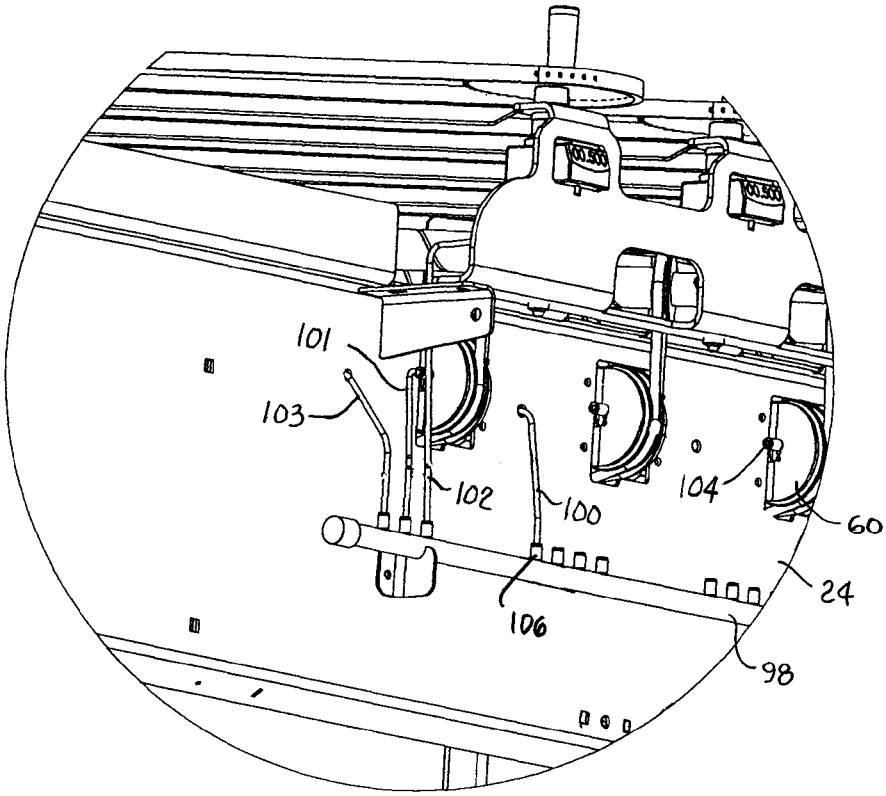
FIG. 6 is an enlarged view of a lubrication system usable in a grader as in FIG. 1.

As shown in FIGS. 2 and 2A, each grading roller 30 is rotated from a motor-driven drive shaft 54 that extends below and generally along the centerline of the grading bed. Drive pulleys 56 are arranged on the drive shaft, each drive pulley associated with one of the grading rollers. Each roller has a roller pulley 58 mounted to it near the first end 32 of the grading bed 22. Two associated idler pulleys 60, 61, supported in the frame 24 as shown in FIG. 6, are positioned between the drive pulley and the roller pulley. A belt 63 is trained around the drive pulley, the pair of idler pulleys, and the roller pulley to transmit the drive rotation from the drive shaft to the grading roller. The drive shaft is located somewhat distant from the roller pulley requiring a long belt length. The long belt, especially when somewhat stretchable, accommodates a range of gap-height adjustments without tightening or loosening the belt too much around the pulleys. A twisted urethane belt, such as one of those sold by DuraBelt, Inc. of Hilliard, Ohio, U.S.A., is one example of a suitable belt.

Figure 3:
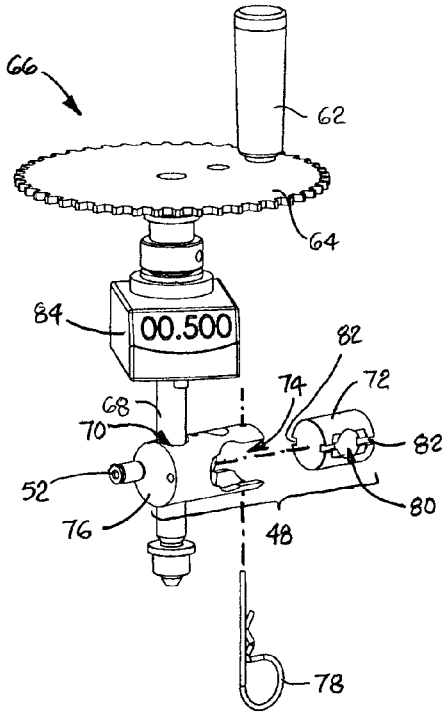
FIG. 3 is an exploded view of a gap-height adjuster usable in a grader as in FIG. 1 at an end of each grading roller and having an adjustment display.
Figure 4:
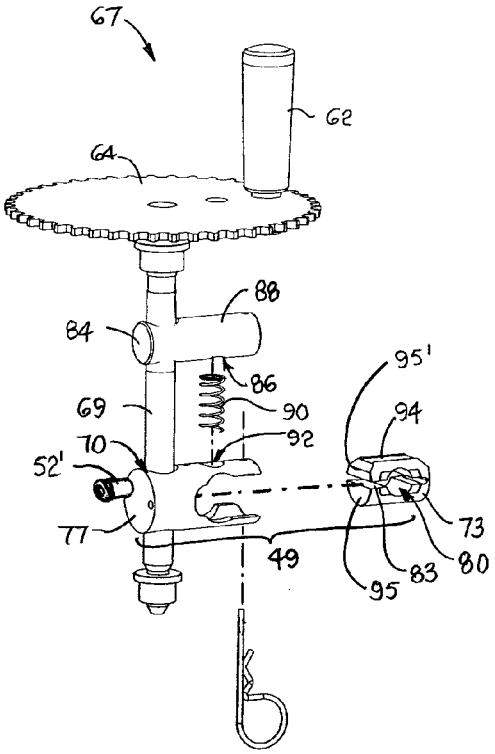
FIG. 4 is an exploded view of a gap-height adjuster usable in the grader of FIG. 1 with a play remover.
Figure 5:
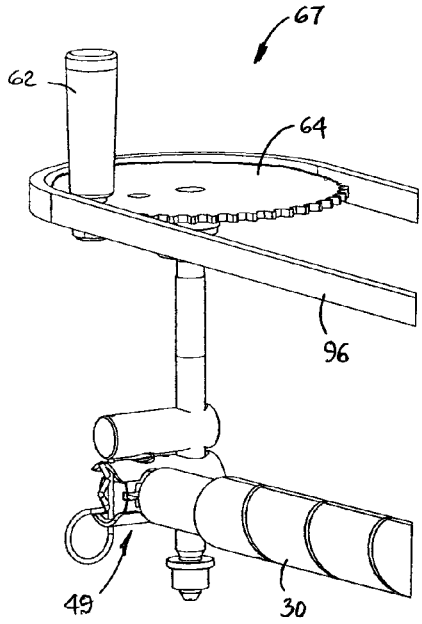
FIG. 5 is an unexploded view of the gap-height adjuster of FIG. 4 showing its connection to a grading roller.

As shown in FIG. 2, the gap-height adjustment mechanism 36 associated with each of the grading rollers 30 includes a handle 62 at each end. The handle 62 is attached to a sprocket 64 and a gap-height adjuster 66, 67 at each of the first and second sides 32, 33 of the grader. As shown in FIGS. 3-5, each gap-height adjuster 66, 67 has a threaded shaft 68, 69 attached at a top end to the center of the sprocket 64. The threaded shafts are received in threaded holes 70 in the bearing assemblies 48, 49. Rotation of the sprockets 64 rotates the threaded shafts, which causes the bearing assemblies to ride up or down along the shaft.

As shown in FIG. 3, the bearing assembly 48 at the first side 32 of the grader includes a cylindrical bearing 72 that is rotatably received in a recess 74 in a bearing holder 76. A hitch pin 78 retains the bearing 72 in the holder 76. The bearing 72 has a radial hole 80 that receives the axle at the end of the associated grading roller. Slots 82 on diametrically opposite sides of the bearing form lubrication channels that admit lubricating fluid injected into the bearing holder 76 through the adapter 52 into the recess 74 and the bearing holder. The gap-height adjuster 66 is optionally outfitted with a display unit 84 that provides a visual indication of the size of the grading gap. The display is shown, in this example, as a counter coupled to the threaded shaft 68.

The gap-height adjuster 67 at the other side of the grader is shown in FIGS. 4 and 5. It is shown without a gap-height display. But it has a threaded shaft 69 that rotates with the sprocket 64. The bearing assembly has a bearing housing 77, which is threadedly coupled to the threaded shaft 69 to travel up and down the shaft as the sprocket 64 is rotated. Also threadedly coupled to the shaft 69 is a play remover 84 that has a hole 86 opening onto the bottom of an arm 88 that extends perpendicularly away from the shaft. The play remover travels along the shaft at the same rate as the bearing assembly. A spring 90 is seated at one end in the hole 86. The opposite end of the spring penetrates a hole 92 in the top of the bearing holder 77 and sits on a flat surface 94 formed on the periphery of a bearing 73. A slot 83 extends diametrically through the cylindrical bearing 73 and intersects the radial hole 80 for the roller's axle. The slot splits a portion of the bearing's length into two portions, such as legs 95, 95', with confronting faces that define the radial hole 80. The spring 90 exerts a compressive force against the slotted bearing 73, pressing one of the legs toward the other. The compressive force results in a hinge action in the bearing. As the bearing wears, the hinge action maintains surface contact between the grading roller's axle and the bearing and reduces play in the end of the roller. Instead of being a one-piece split bearing joined at a hinge, the two legs 95, 95' could be separate bearing portions of a two-piece bearing pressed toward each other by the compressive force of the spring 90 against one of the pieces and the stable backing provided to the other piece by the bearing holder 77. The hitch pin 78 retains the bearing 73 in the holder 77. The bearing 73 is made of polyether ether ketone (PEEK), but could be made of other plastic materials or of metal. A toothed belt or a chain 96 is trained around the sprockets 64 on the gap-height adjuster 66, 67 at opposite sides of the grader. In this way, the gap height can be adjusted from either side.

A lubricating fluid, such as water, is supplied to the idler pulleys 60, 61 as shown in FIG. 6. The fluid is fed from a lubrication manifold 98 mounted along the side of the grader via distribution tubes 100-103. The two idler pulleys 60, 61 associated with each grading roller are fed fluid via tubes 100, 101 that couple to an adapter 104. The two gap-height-adjuster bearing holders 76, 77 (FIGS. 3 and 4) are fed fluid via tubes 102, 103 that couple to the adapters 52, 52'. The four tubes for each grading-roller zone are connected to the manifold 98 by adapters 106. (Only the tubes for one grading zone are shown in FIG. 6 to simplify the drawing.)

Figure 7:
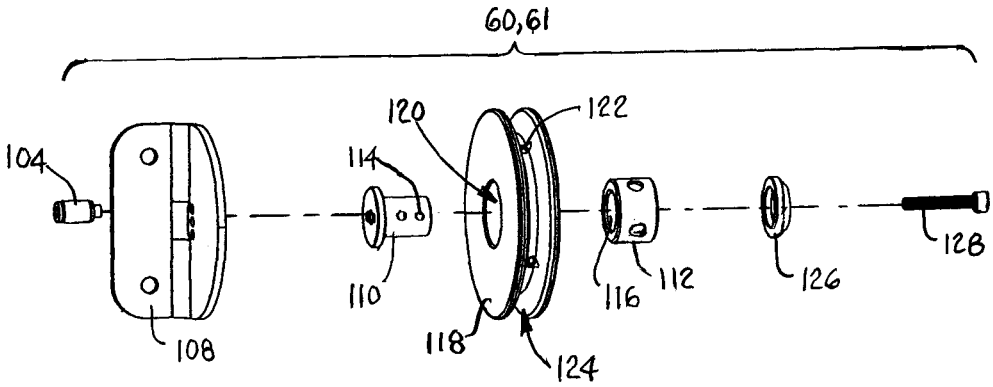
FIG. 7 is an exploded view of an idler pulley assembly usable in a grader as in FIG. 1.

The idler pulley assembly 60, 61 is shown in more detail in FIG. 7. Water is fed through the adapter 104, which is mounted on a bracket 108 attached to the grader frame. A pulley shaft 110 acts as an axle for an idler bushing 112 to ride on. Ports 114 through the shaft 110 deliver lubricating fluid to the bushing's inner contact surface 116. An idler pulley wheel 118 has a central bore 120 that receives the bushing 112. Set screws 122 attach the pulley wheel to the bushing. A sheave 124 on the periphery of the pulley wheel receives the drive belt (63, FIG. 2A). A shaft cap 126 fastened by a screw 128 captures the bushing 112 and the pulley wheel 118 in the pulley assembly 60, 61.

Figure 8:
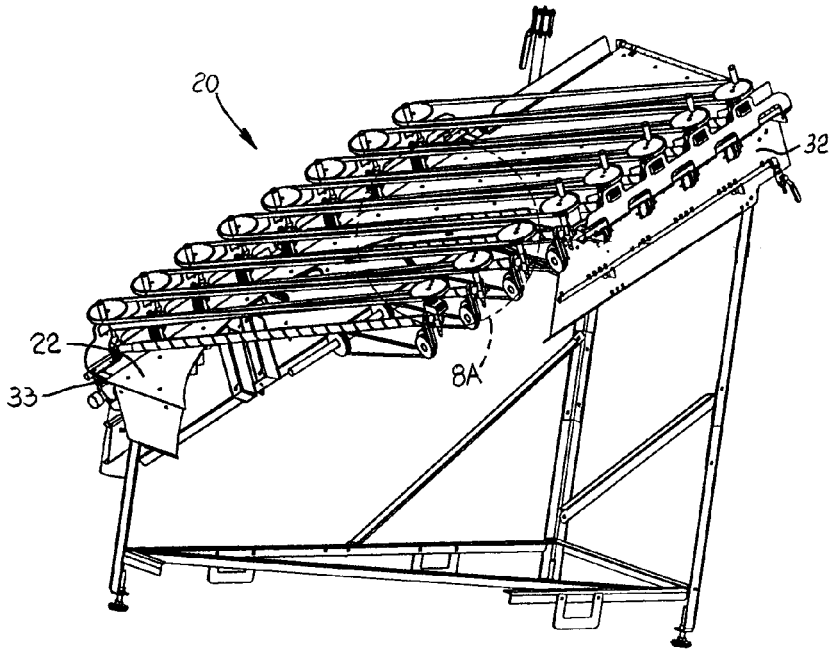
FIG. 8 is a partly cutaway view of the grader of FIG. 1 taken from another perspective.
Figure 8A:
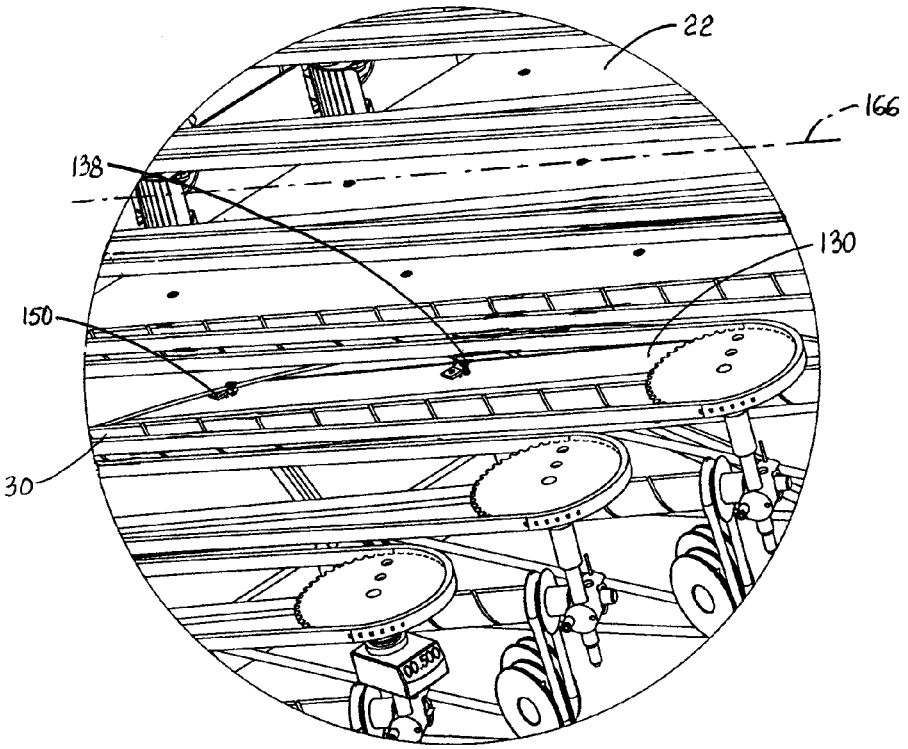
FIG. 8A is an enlarged view of the grading bed of the grader of FIG. 8.
Figure 9:
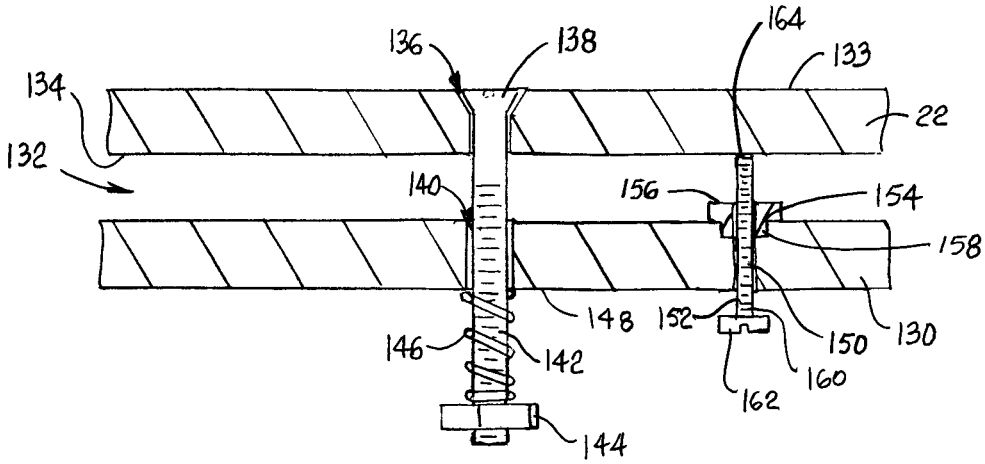
FIG. 9 is a cross section of the grading bed and the support in the grader of FIG. 8.

The grading bed 22 is leveled with features shown in FIGS. 8, 8A, and 9. The grading bed 22 is supported by a support comprising a group of parallel cross members 130. Each grading roller 30 is associated with one of the cross members 130. Like the grading rollers, the cross members are aligned oblique to the first and second sides 32, 33 of the grader 20 and positioned under the grading bed generally just below the rollers. An interstitial space 132 between the bottom surface 134 of the grading bed 22 and the cross member 130 permits the grading bed to be adjusted flat. A countersunk hole 136 extends through the grading bed 22 from the top grading surface 133 to the bottom surface 134. A flat-head screw 138 extends through the countersunk hole and into an aligned hole 140 in the supporting cross member 130. The flat-head screw 138 has a threaded shaft 142. An adjustment nut 144, such as an aircraft nut, on the distal end of the screw confines a spring 146 on the shaft between the nut and a bottom face 148 of the cross member 130. In this way, the flat-head screw, adjustment nut, and bolt serve as biasing means biasing the grading bed 22 toward the cross member 130 across the interstitial space 132.

A jack 150 extends into the interstitial space 132 in close proximity to the flat-head screw 138. The jack 150 comprises a jacking screw 152 and a jacking nut 154, which is preferably a self-locking nut. The jacking nut 154 is affixed to the cross member 130 with a flange portion 156 sitting in the interstice 132 atop the cross member. A barrel portion 158 of the jacking nut extends down into the cross member. The barrel includes a threaded bore 159. The jacking screw 152 has a threaded shaft 160 that is threadedly received in the threaded bore 159 and that extends through the jacking nut and into the interstitial space 132. The head 162 of the jacking screw resides below the cross member for easy access. The distal tip 164 of the jacking screw is raised and lowered by adjusting the screw head 162. As the jacking screw 150 is tightened, its tip advances through the space 132 and into contact with the bottom surface 134 of the grading bed 22. Further tightening of the jacking screw pushes the grading bed away from the cross member against the bias of the spring 146. The self-locking jacking nut 154 prevents vibrations from tightening or loosening the jacking screw 152 from its set position.

As shown in FIGS. 8 and 8A, the flat-head screws 138 and the jacks 150 are arranged generally in a line 166 along each cross member 130. (The line of jacks does not have to be perfectly straight: the positions of the jacks could deviate from a straight line. So the term "line" is not restricted to the meaning "straight line.") The line of jacks and flat-head screws is generally parallel to the axis of the associated grading roller 30. In this way, the jacks can be adjusted to keep the grading bed flat in the vicinity of the grading roller to maintain a uniform grading gap between the roller and the top grading surface of the grading bed. The line 166 of flat-head screws is preferably positioned slightly downstream of the rollers to position the countersunk screw heads out of the grading gap. Thus, each oblique grading roller 30 is associated with a single oblique cross member 130 and a single oblique line of jacks 150 and hold-down springs 146 to enable the grading bed to be adjusted flat at each grading roller for a uniform grading gap and accurately graded product.

What is claimed is:

1. A grader comprising:

a grading bed declining from an upstream infeed end to a lower downstream end and extending in width from a first side to a second side and providing a top grading surface and an opposite bottom surface;

a support underlying the grading bed across a space between the support and the grading bed;

biasing means for biasing the grading bed toward the support;

a plurality of grading rollers extending across the width of the grading bed and spaced above the grading bed across gaps, wherein the grading rollers have axes of rotation oblique to the first and second sides;

a plurality of jacks extending from the support and through the space between the support and the grading bed generally along lines parallel to and proximate the plurality of grading rollers and into contact with the bottom surface of the grading bed, wherein the jacks are height-adjustable to maintain the top grading surface flat proximate the grading rollers.

2. A grader as in claim 1 wherein each of the jacks includes:

a jacking nut affixed to the support confronting the bottom surface of the grading bed; and a jacking screw threadedly received in the jacking nut and extending through the support, the jacking screw having a screw head accessible from below the support and an opposite screw tip extending through the space into contact with the bottom surface of the grading bed, wherein the jacking screw is tightened to push the grading bed away from the support.

3. A grader as in claim 1 wherein the biasing means includes:

a plurality of countersunk holes extending through the grading bed from the grading surface to the bottom surface;

a plurality of holes in the support aligned with the countersunk holes;

a plurality of flat-head screws having threaded shafts extending through the countersunk holes and the holes in the support with the flat heads of the flat-head screws countersunk into the grading surface of the grading bed;

a plurality of adjustment nuts threadedly received on the distal ends of the flat-head screws;

a plurality of springs on the threaded shafts of the flat-head screws exerting spring pressure between the bottom surface of the grading bed and the adjustment nuts, whereby the spring pressure is adjusted by tightening or loosening the adjustment nuts.

4. A grader as in claim 3 wherein the flat-head screws are disposed proximate the jacks.

5. A grader as in claim 1 wherein each of the grading rollers is associated with one of the lines of jacks and wherein the lines of jacks are disposed slightly downstream of the associated grading rollers.

6. A grader as in claim 1 wherein the support comprises a plurality of cross members extending from the first side to the second side parallel to the axes of the grading rollers, wherein each of the cross members is associated with one of the grading rollers.

7. A grader as in claim 1 further comprising:

a motor-driven drive shaft extending below the centerline of the grading bed between the upstream infeed end to the lower downstream end, the drive shaft having a plurality of drive pulleys mounted for rotation with the drive shaft;

a roller pulley mounted to an end of each of the grading rollers proximate one of the first and second ends of the grading bed;

a pair of idler pulleys, each associated with one of the grading rollers and one of the drive pulleys;

a plurality of drive belts, each trained around one of the drive pulleys, the associated pair of idler pulleys, and the associated roller pulley.

8. A grader as in claim 1 further comprising:

a cylindrical bearing at an end of each of the grading rollers, each cylindrical bearing having a radial hole receiving one of the ends of the grading roller, a slot extending diametrically through the cylindrical bearing along a portion of its length to form two confronting legs defining the radial hole, and a flat surface on the periphery of one of the legs;

a spring pressing against the flat surface to bias one of the legs toward the other.

9. A grader as in claim 1 further comprising:

a pair of cylindrical bearings at each end of each of the grading rollers, each cylindrical bearing having a radial hole receiving one of the ends of the grading roller, a slot extending along the axial length of the periphery of the bearing;

a bearing holder associated with each of the cylindrical bearings and having a cylindrical recess receiving the cylindrical bearing and a fluid passage into the recess;

a fluid source supplying a fluid to the bearing holder through the fluid passage to lubricate the cylindrical bearing through the slot;

wherein the cylindrical bearing is made of PEEK.

10. A grader as in claim 1 further comprising a gap-height adjuster coupled to an end of each grading roller for adjusting the height of the gap between the grading roller and the top grading surface of the grading bed, the gap-height adjuster having a display displaying a measure of the height of the gap.

11. A grader as in claim 1 wherein the grading rollers have one or more helical grooves formed in their peripheries.

* * * * *